US006039179A

United States Patent [19]

Weder et al.

[11] Patent Number: 6,039,179

[45] **Date of Patent: *Mar. 21, 2000**

[54] RETAINING FLAP FOR SHIPPING CARTONS

[75] Inventors: Donald E. Weder, Highland; Jack Feld, Edwardsville, both of Ill.

[73] Assignee: Southpac Trust International, Inc.

[ * ] Notice: This patent is subject to a terminal disclaimer.

[21] Appl. No.: 09/024,996

[22] Filed: Feb. 17, 1998

Related U.S. Application Data

[63] Continuation of application No. 08/382,096, Jan. 24, 1995, Pat. No. 5,732,823, which is a continuation of application No. 08/202,058, Feb. 25, 1994, Pat. No. 5,411,137, which is a continuation of application No. 08/093,109, Jul. 16, 1993, Pat. No. 5,311,992, which is a continuation-in-part of application No. 07/892,441, Jun. 2, 1992, Pat. No. 5,240,109, which is a continuation of application No. 07/831,767, Feb. 5, 1992, Pat. No. 5,148,918, which is a continuation-in-part of application No. 07/692,329, Apr. 26, 1991, Pat. No. 5,092,465.

[51] Int. Cl.[7] ..... B65D 85/52

[52] U.S. Cl. ..... 206/423; 206/460

[58] Field of Search ..... 206/423, 460, 206/813; 53/397, 443, 449; 47/84

[56] References Cited

U.S. PATENT DOCUMENTS

| | | | |
|---|---|---|---|
| 1,064,813 | 6/1913 | Bloomberg . | |
| 2,165,539 | 7/1939 | Dahlgren | 206/80 |
| 2,373,634 | 4/1945 | Wagner | 117/122 |
| 2,578,583 | 12/1951 | O'Brien | 206/65 |
| 2,664,670 | 1/1954 | Mulford | 47/37 |
| 2,707,352 | 5/1955 | Fischer | 47/58 |
| 2,721,022 | 10/1955 | Billerbeck | 229/52 |
| 2,744,624 | 5/1956 | Hoogstoel et al. | 206/65 |
| 2,871,080 | 1/1959 | Shelly | 312/107 |
| 2,887,220 | 5/1959 | Hankus | 206/65 |
| 3,113,673 | 12/1963 | Stein | 206/65 |
| 3,322,323 | 5/1967 | Green et al. | 229/37 |
| 3,374,884 | 3/1968 | Chinkes | 206/62 |
| 3,389,784 | 6/1968 | Hendricks et al. | 206/47 |
| 3,466,214 | 9/1969 | Polk et al. | 156/213 |
| 3,488,022 | 1/1970 | Vittori | 248/152 |
| 3,524,583 | 8/1970 | Gregory | 229/87 |
| 3,708,946 | 1/1973 | Cahill | 53/37 |
| 3,725,188 | 4/1973 | Kalt | 161/116 |
| 3,734,280 | 5/1973 | Amneus et al. | 206/65 R |
| 3,754,642 | 8/1973 | Stidolph | 206/45.14 |
| 3,883,990 | 5/1975 | Stidolph | 47/58 |

(List continued on next page.)

FOREIGN PATENT DOCUMENTS

| | | |
|---|---|---|
| 192843 | 11/1957 | Austria . |
| 686577 | 12/1995 | European Pat. Off. . |
| 2221936 | 10/1974 | France . |
| 8026641 | 12/1980 | France . |
| 2735225 | 4/1978 | Germany . |
| 61058 | 1/1989 | Japan . |
| 4352664 | 12/1992 | Japan . |
| 8101464 | 3/1981 | Netherlands . |
| 26878 | 11/1913 | United Kingdom . |
| 432899 | 8/1935 | United Kingdom . |

OTHER PUBLICATIONS

"The Museum Putty" brochure "Is Your Home a Museum of Collectibles?", 3 pages, Aug. 2, 1993.

Oasis Grower Products; Smithers–Oasis; Kent, OH; 1991.

*Primary Examiner*—Jim Foster

*Attorney, Agent, or Firm*—Dunlap, Codding & Rogers, P.C.

[57] ABSTRACT

Retaining flaps for shipping cartons, with bonding material disposed on at least a portion of the flaps, are provided. The flaps are interposed between delicate items, such as, for example, floral grouping assemblies, to hold the delicate items essentially immobile within a shipping carton in order to prevent damage from internal movement of the delicate items when the shipping carton is transported. The bonding material disposed on the flaps releasably connects to portions of the floral grouping wrappings and to portions of the internal surface of the shipping carton. The flaps can be constructed of a flexible or a rigid material.

8 Claims, 7 Drawing Sheets

U.S. PATENT DOCUMENTS

| | | | |
|---|---|---|---|
| 3,924,354 | 12/1975 | Gregoire | 47/34.11 |
| 4,053,049 | 10/1977 | Beauvais | 206/318 |
| 4,170,301 | 10/1979 | Jones et al. | 206/423 |
| 4,248,347 | 2/1981 | Trimbee | 206/423 |
| 4,396,120 | 8/1983 | Morita | 206/460 |
| 4,470,508 | 9/1984 | Yen | 206/334 |
| 5,065,922 | 11/1991 | Harris | 224/42.32 |
| 5,092,465 | 3/1992 | Weder et al. | 206/423 |
| 5,111,638 | 5/1992 | Weder | 53/397 |
| 5,148,918 | 9/1992 | Weder et al. | 206/423 |
| 5,195,637 | 3/1993 | Weder | 206/423 |
| 5,240,109 | 8/1993 | Weder et al. | 206/423 |
| 5,255,784 | 10/1993 | Weder et al. | 206/423 |
| 5,311,992 | 5/1994 | Weder et al. | 206/423 |
| 5,322,181 | 6/1994 | Nelson | 220/461 |
| 5,407,072 | 4/1995 | Weder et al. | 206/423 |
| 5,411,137 | 5/1995 | Weder et al. | 206/423 |
| 5,522,205 | 6/1996 | Weder | 53/475 |
| 5,564,567 | 10/1996 | Weder | 206/423 |

RETAINING FLAP FOR SHIPPING CARTONS

CROSS-REFERENCE TO RELATED APPLICATIONS

This application is a continuation of U.S. Ser. No. 08/382,096, entitled "Retaining Flap for Shipping Cartons," filed Jan. 24, 1995, now U.S. Pat. No. 5,732,823, which is a continuation of U.S. Ser. No. 08/202,058, filed Feb. 25, 1994, entitled "Retaining Flap for Shipping Cartons," now U.S. Pat. No. 5,411,137 issued May 2, 1995; which is a continuation of U.S. Ser. No. 08/093,109, filed Jul. 16, 1993, entitled "Retaining Flap for Shipping Cartons," now U.S. Pat. No. 5,311,992 issued May 17, 1994; which is a continuation-in-part of U.S. Ser. No. 07/892,441, filed Jun. 2, 1992, entitled "Retaining Flap for Shipping Cartons," now U.S. Pat. No. 5,240,109 issued Aug. 31, 1993; which is a continuation of 07/831,767, filed Feb. 5, 1992, entitled "Shipping Carton for Floral Grouping Assemblies," now U.S. Pat. No. 5,148,918 issued Sep. 22, 1992; which is a continuation-in-part of U.S. Ser. No. 07/692,329, filed Apr. 26, 1991, entitled "Shipping Carton for Floral Grouping Assemblies," now U.S. Pat. No. 5,092,465, issued Mar. 3, 1992.

FIELD OF THE INVENTION

The present invention generally relates to cartons for shipping or transporting delicate items, such as floral groupings, and more specifically to retaining flaps which are interposed between and among the delicate items, in order to substantially immobilize the delicate items within the shipping carton to thereby prevent damage to the delicate items by movement.

BRIEF DESCRIPTION On THE DRAWINGS

DESCRIPTION OF THE PREFERRED EMBODIMENTS

Figure 1:
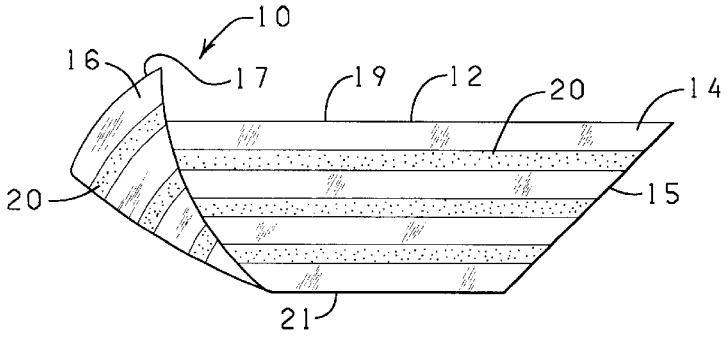
FIG. 1 is a perspective view of a flexible retaining wrap constructed in accordance with the present invention.

Shown in FIG. 1 is a retaining flap constructed in accordance with the present invention and designated by the general reference numeral 10. The flap 10 is constructed of a flexible sheet of material 12 having an upper surface 14, a lower surface 16, a first end 15, a second end 17, a first side 19 and a second side 21. A bonding material is disposed in strips of bonding material, one strip of bonding material being shown and designated with the reference numeral 20, the strips of bonding material, such as bonding material strip 20, extending generally from the first end 15 to the second end 17 of the sheet of material 12.

The sheet of material 12 is constructed from any suitable flexible material that is capable of being formed in accordance with the present invention, as will be explained below. Preferably, the flexible sheet of material 12 is constructed of a material selected from a group of materials consisting of paper, metal foil, cloth (natural or synthetic), denim, burlap or polymer film or combinations is thereof.

The term "polymer" as used herein means any polymer film. For example, but not by way of limitation, one polymer film is a polypropylene film. Another example of a polymer film is cellophane.

The sheet of material 12 has a thickness in a range from about 0.1 mils to about 30 mils. Preferably, the sheet of material has a thickness in a range from about 0.1 mils to about 5 mils. The sheet of material 12 may be of any shape and a rectangular shape is shown in FIG. 1 only by way of example. The sheet of material, for example, may be square, circular, or any other geometric shape. The sheet of material 12 may be constructed of a single layer of material or a plurality of layers of the same or different types of materials. Any thickness of the sheet of material 12 may be utilized with the present invention as long as the sheet of material is capable of being formed in accordance with the present invention. The layers of material comprising the sheet of material 12 may be connected together or laminated or may be separate layers.

The term "bonding material" as used herein means a pressure sensitive adhesive, preferably a pressure sensitive adhesive, or a cohesive. Where the bonding material is a cohesive, a similar cohesive material must be placed on the adjacent surface for bondingly contacting and bondingly engaging with the cohesive material. The term "bonding material" as used herein means any type of material or thing which can be used to effect the bonding or connecting of the two adjacent portions of the material or sheet of material as described herein.

Figure 2:
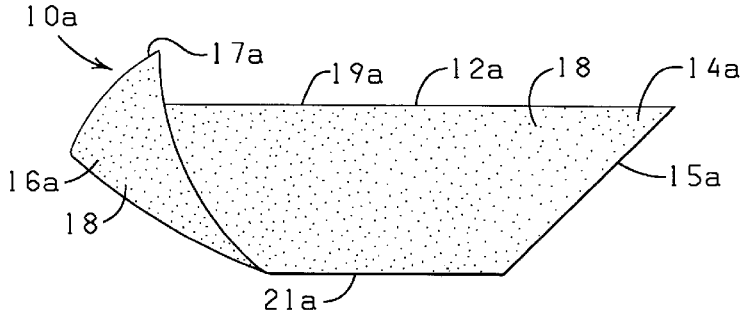
FIG. 2 is a perspective view of another flexible retaining flap constructed in accordance with the present invention.

Shown in FIG. 2 is a flap 10*a* constructed of a flexible sheet of material 12*a*, and having an upper surface 14*a*, a lower surface 16*a*, a first end 15*a*, a second end 17*a*, a first side 19*a*, and a second side 21*a*. The flexible sheet of material 12*a*, as shown in FIG. 2, has bonding material 18 disposed generally across the upper surface 14*a* and the lower surface 16*a* of the sheet of material 12*a*.

Figure 3:
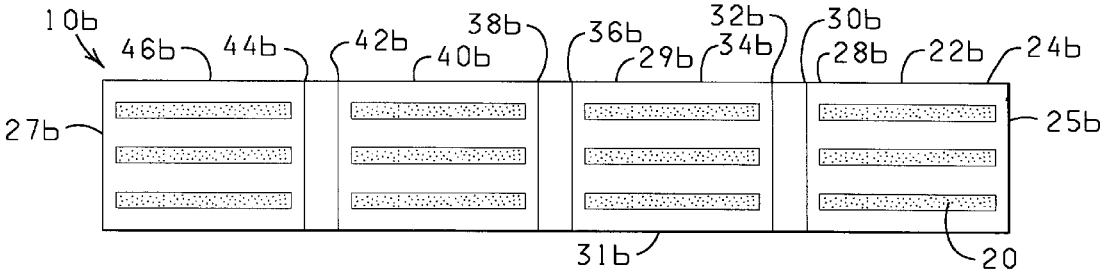
FIG. 3 is a perspective view of a retaining flap comprising a rigid material and constructed in accordance with the present invention.

Shown in FIG. 3 is a retaining flap 10*b* constructed in accordance with the present invention. The flap 10*b* is constructed of a rigid sheet of material 22*b*. The rigid sheet of material 22*b* comprises any material that can be formed in accordance with the present invention, Examples of materials from which the rigid sheet of material 22*b* can be constructed include, solely by way of illustration and not by way of limitation, cardboard, metal foil, such as aluminum foil, and plastic sheet, such as polyethylene sheet. The rigid sheet of material 22*b* includes an upper surface 24*b*, a lower surface 26*b* (not shown) a first end 25*b*, a second end 27*b*, a first side 29*b*, and the second side 31*b*.

The rigid sheet of material 22*b* also comprises at least two panels, the rigid sheet of material 22*b* shown in FIG. 3 comprising a first panel 28*b*, a second panel 34*b*, a third panel 40*b*, and a fourth panel 46*b*.

The first panel 28*b* extends generally from the first end 25*b* to the fold line 30*b*. A fold line 32*b* is separated a distance from the fold line 30*b* and the second panel extends from the fold line 32*b* to the fold line 36*b*. A fold line 38*b* is separated a distance from the fold line 36*b*, and the third panel 40*b* extends from the fold line 38*b* to a fold line 42*b*. The fold line 44*b* is separated a distance from the fold line 42*b* and the fourth panel 46*b* extends generally from the fold line 44*b* to the second end 27*b* of the rigid sheet of material 22*b*. As shown in FIG. 3, the panels 28*b*, 34*b*, 40*b*, and 46*b*, are generally the same size, but in other embodiments of the invention, the size of the panels comprising a sheet of material 22*d* can vary.

The rigid sheet of material 22*b* additionally has strips of bonding material 20 disposed on the upper surface 24*b* and the lower surface 26*b* (not shown). One strip of bonding material is designated generally by the reference numeral 20.

Figure 4:
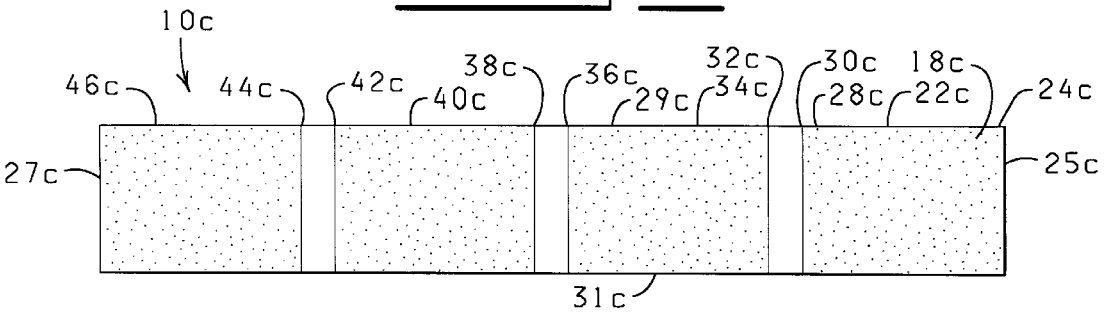
FIG. 4 is a perspective view of another retaining-flap comprising a rigid material and constructed in accordance with the present invention.

FIG. 4 shows a retaining flap 10*c* constructed of a rigid sheet of material 22*c*. The rigid sheet of material 22*c* has a upper surface 24*c*, a lower surface 26*c* (not shown), a first end 25*c*, a second end 27*c*, and a first side 29*c* and a second side 31*c*. The retaining flap 10*c* will comprise at least two panels. The retaining flap 10*c* shown in FIG. 4 comprises a first panel 28*c*, a second panel 34*c*, a third panel 40*c* and a fourth panel 46*c*. The first panel 28*c* extends generally from the first end 25*c* to a fold line 30*c*. A fold line 32*c* is separated a distance from the fold line 30*c*, and the second panel 34*c* extends from the fold line 32*c* to a fold line 36*c*. A fold line 38*c* is separated a distance from the fold line 36*c*, and the third panel 40*c* extends from the fold line 36*c*. to a fold line 42*c*. The fold line 44*c* is separated a distance from the fold line 42*c* and a fourth panel 46*c* extends from the fold line 44*c* to the second end 27*c* of the flexible or rigid sheet of material 22*c*. A bonding material 18*c* is disposed generally on the panels, such as the panels 28*c*, 34*c*, 40*c* and 46*c* shown in FIG. 4, on the upper surface 24*c* and the lower surface 26*c* of the rigid sheet of material 22*c*.

Figure 5:
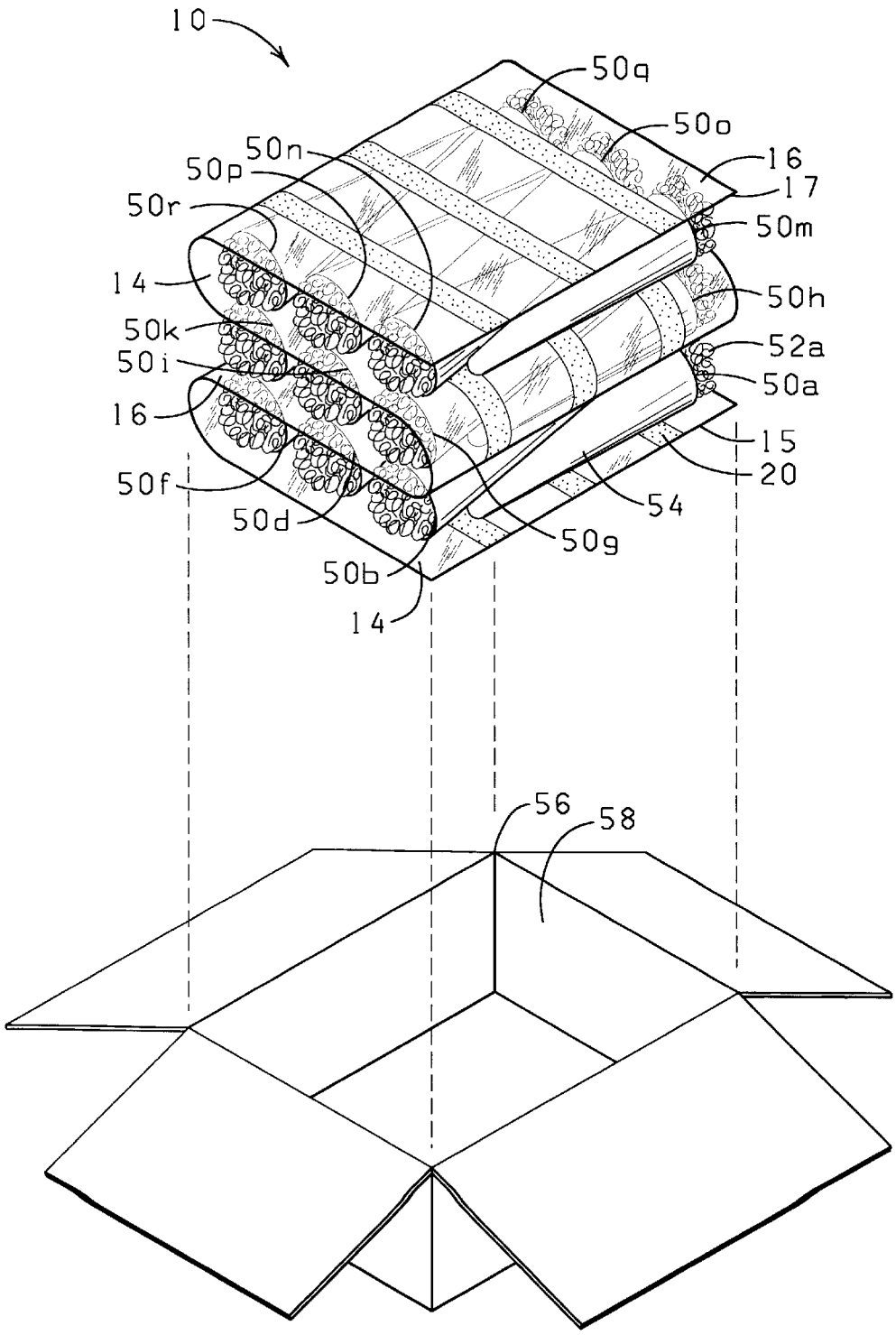
FIG. 5 is a perspective view of the flexible retaining flap shown in FIG. 1 disposed about a plurality of floral grouping assemblies.

FIG. 5 is a perspective view of a retaining flap 10, constructed in accordance with the present invention, disposed about a plurality of floral grouping assemblies 50. As shown in FIG. 5, the floral grouping assemblies 50 are oriented to be disposed in a carton or carton 56 having an inner surface 58 defining a receiving space. A first layer of floral grouping assemblies is comprised of the floral grouping assemblies 50*a* through 50*f*. A second layer of floral grouping assemblies is comprised of the floral grouping assemblies 50*g* through 50*l* (50*l* not shown), and a third layer of floral grouping assemblies is comprised of the floral grouping assemblies 50*m* through 50*r*. Floral grouping assembly 50*a* is representative of the floral grouping assemblies 50 shown in FIG. 5. The floral grouping assembly 50*a* comprises a floral grouping having a bloom end 52*a* and a stem end, which is generally encompassed by a floral grouping wrap 54. The present invention can also be used with a floral grouping without the floral grouping wrap 54. In that event, the bonding material disposed on the retention flap, such as the retention flaps 10 or 10*a*, will comprise an adhesive. Floral groupings, in general, possess the characteristic of being of delicate construction, and are subject to crushing and tearing when a plurality of floral grouping assemblies 50 are placed in a carton, such as the carton 56. The floral grouping assemblies 50 may be compressed or torn when additional floral grouping assemblies 50 are placed in the carton 56, or as a result of movement of the floral grouping assemblies 50 within the carton 56 unless the floral grouping assemblies 50 are essentially immobilized.

As shown in FIG. 5, the first end 15 and the upper surface 14 of the flexible sheet of material 12 is placed generally underneath the first layer of floral grouping assemblies 50*a* to 50*f*. The bonding strips, such as bonding strip 20, releasably connect to a portion of the floral grouping wrap comprising part of a floral grouping assembly, such as the floral grouping wrap 54 comprising part of the floral grouping assembly 50*a*.

The sheet of material 22 is then fed over the first layer of floral grouping assemblies 50*a* to 50*f* so the upper surface 14 of the sheet of material 12 releasably connects to additional portions of the floral wrap comprising part of the floral grouping assemblies 50*a* to 50*f*. The second layer of floral grouping assemblies 50*g* through 50*l* is placed on a portion of the lower surface 16 of the sheet of material 12 so that a portion of the floral wrap comprising the floral grouping assemblies 50*g* through 50*l* is releasably connected to the lower surface 16 of the sheet of material 12 via the bonding strips, such as the bonding strip 20. The sheet of material is then folded over the second layer of floral grouping assemblies 50*g* through 50*l* so that an additional portion of the lower surface 16 of the sheet of material 12 comes in contact, via the bonding strips, with additional portions of the floral wrap comprising part of the floral grouping assemblies 50*g* through 50*l*. Finally, a third layer of floral grouping assemblies 50*m* through 50*r* is disposed on the upper surface 14 on an additional portion of the upper surface 14 of the sheet of material 12, a portion of the floral wrap comprising the floral grouping assemblies 50*m* through 50*r* coming in contact with the bonding strips disposed on the upper surface 14 of the sheet of material 12. The sheet of material 12 is folded over the third layer of floral grouping assemblies 50*m* through 50*r* so an additional portion of the bonding strips disposed on the upper surface 14 of the sheet of material 12 comes in contact with an additional portion of the floral wrap comprising the floral grouping assemblies 50*m* through 50*r*.

It is understood that the general size of the sheet of material 12 will be determined by the number of floral grouping assemblies 50 to be disposed in the carton 56. Three layers of floral grouping assemblies 50 are shown in FIG. 5, but additional layers, or fewer layers, can be used, consistent with the present invention. Generally, however, it is contemplated that at least a first layer of floral grouping assemblies 50 and a second layer of floral grouping assemblies 50 will be used in accordance with the present invention.

Figure 6:
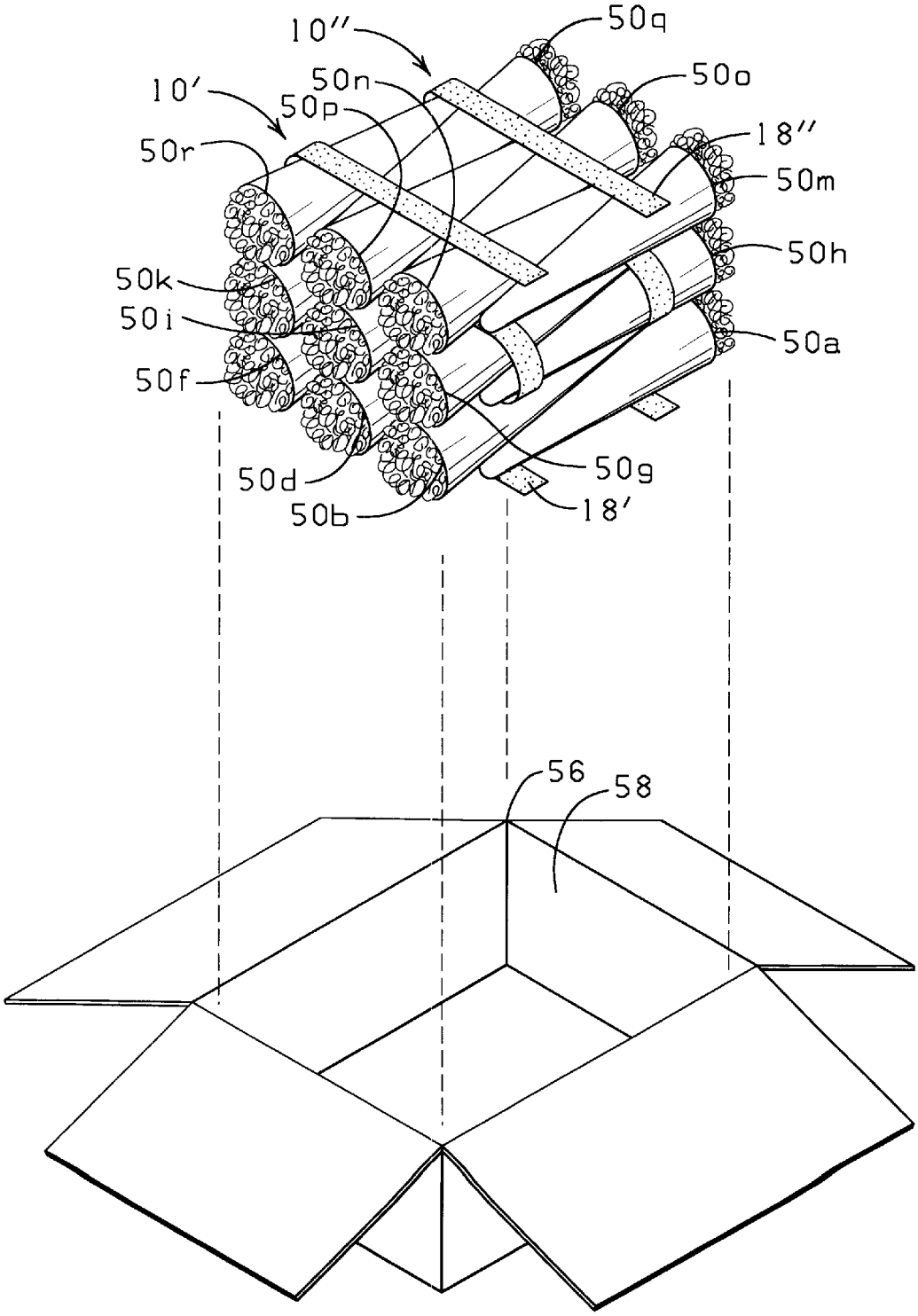
FIG. 6 is a perspective view of two flexible retaining flaps, similar to the retaining flap shown in FIG. 2, disposed about a plurality of floral grouping assemblies.

FIG. 6 shows a perspective view of two retaining flaps, designated generally as retaining flaps 10' and 10", constructed in accordance with the present invention. As shown in FIG. 6, the flaps 10' and 10" are interwoven among a first layer of floral grouping assemblies 50*a* to 50*f*, a second layer of floral grouping assemblies 50*g* to 50*l*, to a third layer of floral grouping assemblies 50*m* to 50*r*, in exactly the same manner as the flap 10, shown in FIG. 5. However, the flap 10 shown in FIG. 5 is sized to generally fit within the cross sectional space defined by the inner surface 58 of the carton 56, whereas two flaps 10' and 10" performing the same function but occupying less space, are shown in FIG. 6. It is understood that, in a particular embodiment of the invention, additional flaps, such as flaps 10' and 10", can be used in accordance with the invention. The flaps 10' and 10" have bonding material 18' or 18" disposed on the surfaces thereof, the bonding material 18' or 18" releasably connecting to a portion of the floral wraps of the floral grouping assemblies 50*a* to 50*r* to hold the floral groupings 50*a* to 50*r* essentially immobile when the floral groupings 50*a* to 50*r* are disposed in the carton 56.

Figure 7:
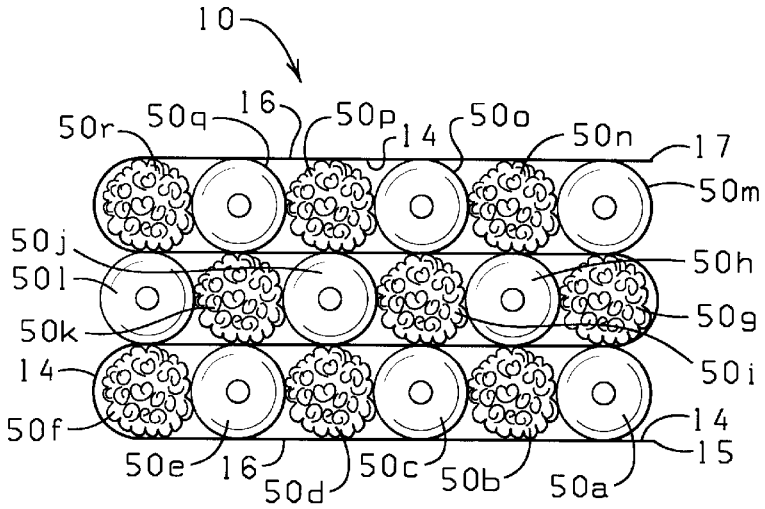
FIG. 7 is a side view of the flexible retaining flap shown in FIG. 1, disposed about a plurality of floral grouping assemblies.

Shown in FIG. 7 is a side view of a flap 10 disposed about a first layer of floral grouping assemblies 50*a* to 50*f*, a second layer of floral grouping assemblies 50*g* to 50*l*, and a third layer of floral grouping assemblies 50*m* through 50*r*. As shown in FIG. 7, the flap 10 operates to hold the floral grouping assemblies 50 essentially immobile and in a fixed orientation relative to each other.

Figure 8:
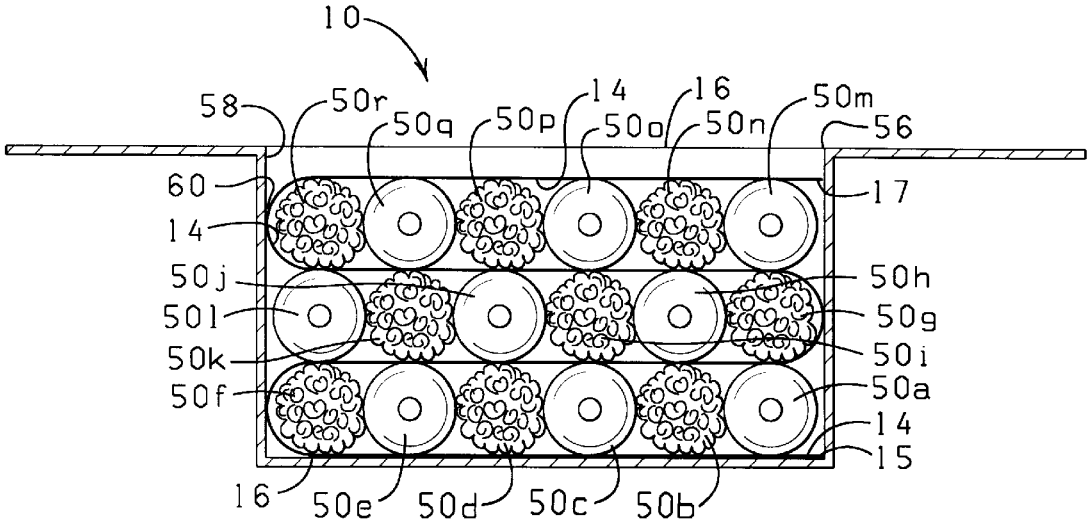
FIG. 8 is a side view of the retaining flap and floral grouping assemblies shown in FIG. 7, disposed in a carton.

Shown in FIG. 8 are the floral grouping assemblies 50*a* through 50*r* shown in FIG. 7, with the retaining flap 10 shown, in FIG. 7 disposed about the floral grouping assemblies 50*a* to 50*r*, the floral grouping assemblies 50*a* to 50*r* being disposed in the receiving space of a carton 56. As shown in FIG. 8, the lower surface 16 of the sheet of material 12 is located generally adjacent a portion of the inner surface 58 of the carton 56, and the upper surface 14 of the sheet of material 12 is disposed generally under a first layer of floral grouping assemblies 50*a* through 50*f*. A portion of the bonding strips disposed on the sheet of material 12 (not shown), located on the lower surface 16 of the sheet of material 12 comes in contact with a portion of the inner surface 58 of the carton 56, thereby holding the portion of the sheet of material 12 in contact with a portion of the inner surface 58 of the carton 56 generally immobile within the carton 56. In turn, portions of the floral wrap comprising a portion of the floral grouping assemblies 50*a* through 50*f* is in contact with at least a portion of the bonding strips disposed on the upper surface 14 of the sheet of material 12, causing the floral grouping assemblies 50*a* through 50*f* to be held generally immobile on a portion of the sheet of material 12.

The sheet of material 12 is generally held against additional posts of the inner surface 58 of the carton 56 at other contact points, such as the contact point 60. The sheet of material 12 therefor cooperates with the carton 56 to hold the floral grouping assemblies 50 generally immobile within the carton 56.

Figure 9:
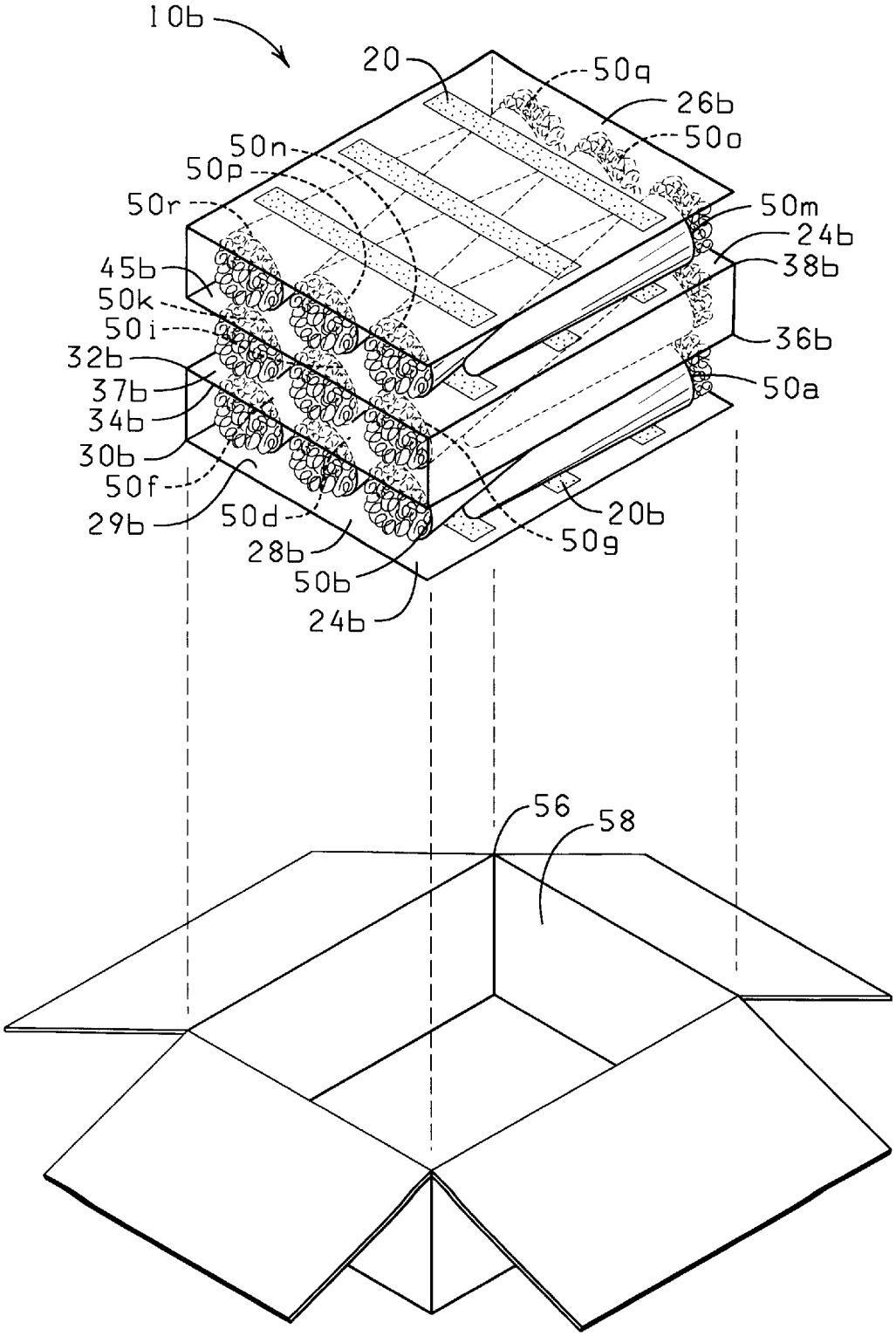
FIG. 9 is a perspective view of the retaining flap shown in FIG. 3 disposed about a plurality of floral grouping assemblies.

Shown in FIG. 9 is the retaining flap 10*b* shown in FIG. 3 disposed about a plurality of floral grouping assemblies 50*a* to 50*r*. The retaining flap 10*b* comprises a first panel 28*b*, which is disposed generally underneath a first layer of floral grouping assemblies 50*a* to 50*f*, a second panel 34*b*, disposed generally between the first layer of floral grouping assemblies 50*a* to 50*f* and a second layer of floral grouping assemblies 50*g* through 50*l*, the first panel 28*b* and the second panel 34*b* cooperating to form a first retention pocket 29*b*, generally encompassing the first layer of floral grouping assemblies 50*a* to 50*f*.

The third panel 40*b* extends generally above the second layer of floral grouping assemblies 50*g* through 50*l* forming a second retention pocket 37*b* and the fourth panel extending generally above the third layer of floral grouping assemblies 50*m* through 50*r* forming, with the second panel, a third retention pocket 45*b*.

The effect of folding the first panel 28*b*, the second panel 34*b*, the third panel 40*b* and the fourth panel 46*b* as shown in FIG. 9 is to create three retention pockets 29*b*, 37*b* and 45*b*, the retention pockets each securing a portion of the floral grouping assemblies 50*a* through 50*r*.

As shown in FIG. 9, the retaining flap 10*b* comprises on a first surface 24*b* and a second surface 26*b* a plurality of bonding strips, one of the bonding strips being shown and denominated by the reference numeral 20*b*. The bonding strips contact portions of the floral grouping assemblies 50*a* to 50*r*, thereby cooperating with the structure of the retaining flap 10*b* to hold the floral grouping assemblies 50*a* to 50*r* essentially immobile when the floral grouping, assemblies 50*a* to 50*r* are disposed within the carton 56.

Figure 10:
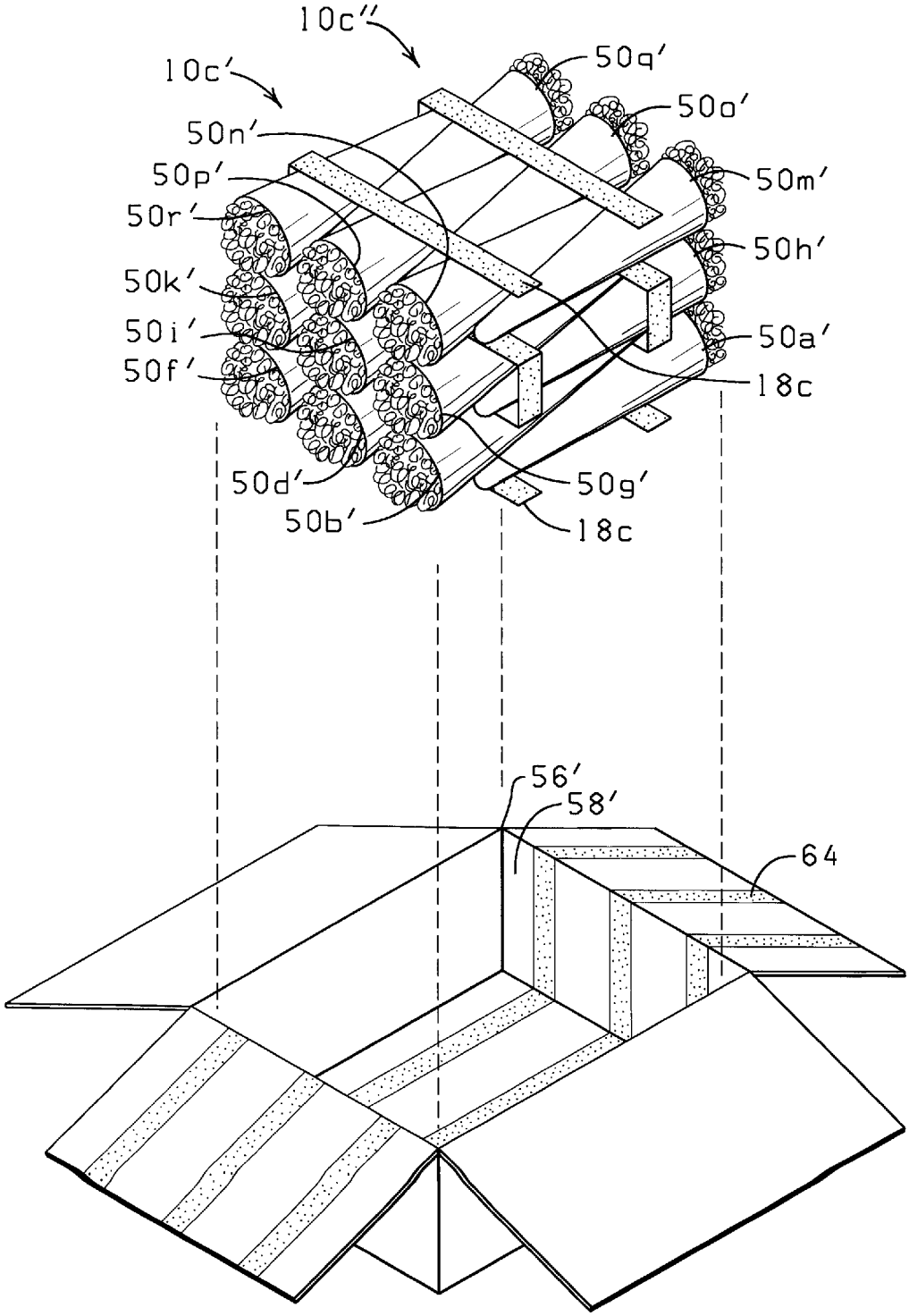
FIG. 10 is a perspective view of two retaining flaps, similar to the retaining flap shown in FIG. 4, disposed about a plurality of floral grouping assemblies.

Shown in FIG. 10 are two retaining flaps 10*c'* and 10*c"*. The retaining flaps 10*c'* and 10*c"* operate in exactly the same manner as the retaining flap 10*b* shown in FIG. 9, except that the retaining flap 10*b*, when disposed around the floral grouping assemblies 50*a* to 50*r* generally encompasses the floral grouping assemblies, whereas the retaining flaps 10*c'* and 10*c"* each encompass only a portion of the floral grouping assemblies 50*a'* to 50*r'*. Additionally, the bonding material 18*c* disposed on the retaining flaps 10*c'* and 10*c"* in this embodiment of the invention, comprise a cohesive. For that reason, the floral wrap comprising a portion of the floral grouping assemblies 50*a'* through 50*r'* must be at least partially covered with a cohesive, as shown in FIG. 10. Additionally, the carton 56', shown disposed below the first layer of floral grouping assemblies 50*a'* through 50*f'*, the second layer of floral grouping assemblies 50*g'* through 50*l'* and the third layer of floral grouping assemblies 50*m'* through 50*r'* has cohesive disposed in the form of cohesive strips across at least a portion of the interior 58' of the carton 56'. One of the cohesive strips is designated by the numeral 64. In operation, the cohesive disposed on the retaining. flaps 10*c'* and 10*c"* will releasably connect to a portion of the cohesive strips, such as the cohesive strip 64, disposed on the interior surface 58' of the carton 56', cooperating to hold the retaining flaps 10*c'* and 10*c"* essentially immobile within the carton 56'. In turn, the cohesive on the retaining flaps 10*c'* and 10*c"* will raleasably connect to the cohesive disposed on a portion of the floral grouping assemblies 50*a'* through 50*r'* to hold the floral grouping assemblies 50*a'* through 50*r'* essentially immobile within the retaining flaps 10*c'* and 10*c"* when the retaining flaps 10*c'* and 10*c"* are disposed within the carton 56'.

Figure 11:
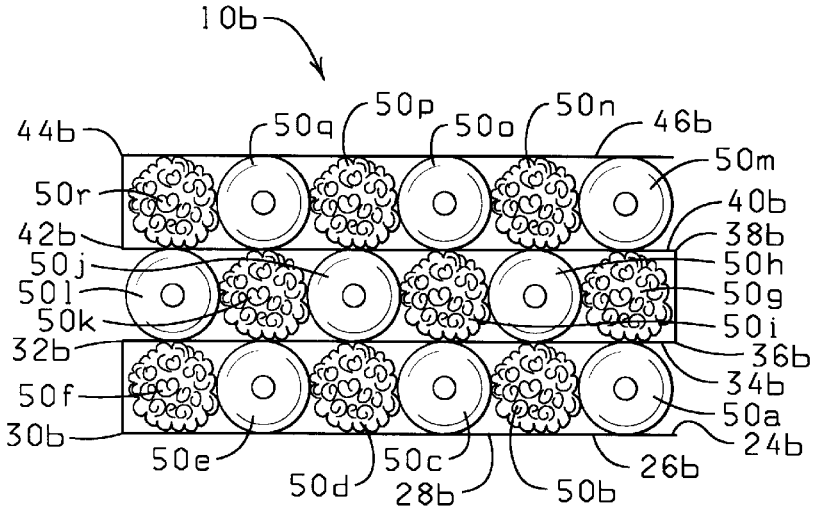
FIG. 11 is a side view of the retaining flap shown in FIG. 3, disposed about a plurality of floral grouping assemblies.

Shown in FIG. 11 is a side view of the retaining flap 10*b* shown in FIG. 3, disposed about a first layer of floral grouping assemblies 50*a* through 50*f*, a second layer of floral grouping assemblies 50*g* through 50*l*, and a third layer of floral grouping assemblies 50*m* through 50*r*. The first panel 28*b* and the upper surface 24*b* of the second panel 34*b* generally encompass the first layer of floral grouping assemblies 50*a* through 50*f*, the lower surface 26*b* of the second panel 34*b* and the lower surface 26*b* of the third panel 40*b* generally encompass the second level of floral grouping assemblies 50*g* through 50*l*, and the upper surface 24*b* of the third panel 40*b* and the upper surface 24*b* of the fourth panel 46*b* generally encompass the third level of floral grouping assemblies 50*m* through 50*r*. As shown in FIG. 11, the first and second panels cooperate to form a first floral grouping retention pocket 29*b*, the second and third panels cooperate to form a second floral grouping retention pocket 37*b*, and the third and fourth panels cooperate to formula third floral grouping retention pocket 45*b*.

Figure 12:
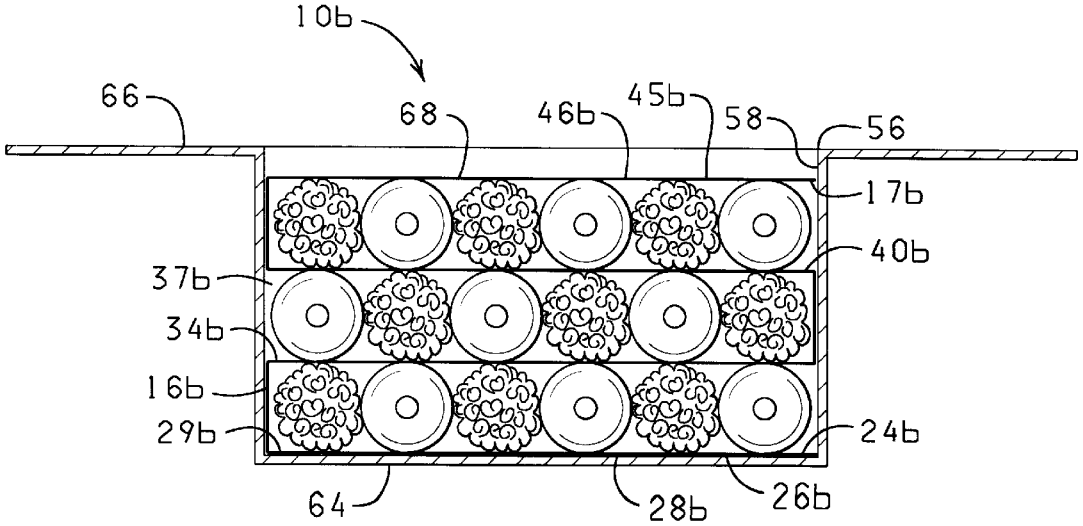
FIG. 12 is a side view of the retaining flap and floral grouping assembly shown in FIG. 11, disposed in a carton.

When placed in a carton 56 as shown in FIG. 12, the bonding strips disposed on a portion of the retaining flap 10*b* (not shown) releasably connect to a portion of the interior surface 58 of the carton 56, in order to hold the retaining flap 10*b* essentially immovable within the carton 56.

Additionally, portions of other bonding strips disposed on the retaining flap 10*b* releasably connect with portions of the floral grouping assemblies 50*a* to 50*r*, thereby cooperating with the rigidity of the first panel 28*b*, the second panel 34*b*, the third panel 40*b* and the fifth panel 46*b* to hold the floral grouping assemblies 50*a* to 50*r* essentially immobile when the floral grouping assemblies 50, disposed within the retaining flap 10*b*, are inserted and encompassed by the carton 56.

Changes may be made in the embodiments of the invention described herein or in parts or elements of the embodiments described herein or in the steps or in the sequence of steps of the methods described herein without departing from the spirit and scope of the invention as defined in the following claims.

What is claimed is:

1. A shipping assembly, comprising:

shipping means having a support surface for accommodating objects to be shipped wherein the objects to be shipped are wrapped objects;

a sheet of material disposed in contact with at least a portion of the support surface of the shipping means and with at least a portion of at least one of the objects to be shipped; and a bonding material wherein the bonding material bondingly connects at least a portion of the sheet of material to the support surface of the shipping means and bondingly connects at least a portion of each of the objects to the sheet of material such that the objects are kept generally immobile with respect to the support surface of the shipping means and wherein the objects to be shipped are positioned in at least two tiers with a portion of the sheet of material separating the two tiers.

2. The shipping assembly of claim 1 wherein the bonding material is an adhesive or cohesive bonding material.

3. The shipping assembly of claim 1 wherein the shipping means further comprises an inner surface and wherein at least a portion of the sheet of material is bondingly connected to the inner surface to restrict movement of the objects with respect to the shipping surface of the shipping means.

4. A shipping assembly comprising:

shipping means having a shipping surface;

a plurality of objects each having a wide end and a narrow end;

a sheet of material; and wherein at least a portion of the sheet of material is bondingly connected to the shipping surface of the shipping means by the bonding material and at least a portion of each object is bondingly connected to the sheet of material by the bonding material and wherein the objects are positioned in alternating orientation with said wide ends and narrow ends being adjacent one another.

5. The shipping assembly of claim 4 wherein the bonding material comprises an adhesive or cohesive bonding material.

6. A shipping assembly for holding a floral grouping assembly to be shipped, the shipping assembly comprising:

a shipping surface;

a plurality of floral grouping assemblies, each floral grouping assembly comprising a floral grouping surrounded by a wrapper;

a retaining flap comprising a flexible sheet of material;

a bonding material;

wherein the retaining flap is positioned about the plurality of floral grouping assemblies to be shipped and wherein the bonding material bondingly connects at least a portion of each floral grouping assembly to the retaining flap and wherein the bonding material bondingly connects at least a portion of the retaining flap to the shipping surface such that each floral grouping assembly is substantially prevented from moving during shipping of the floral grouping assemblies; and wherein each floral grouping assembly has a wide end and a narrow end and is positioned such that the wide end of each floral grouping is positioned adjacent the narrow end of each adjacent floral grouping.

7. A shipping assembly, comprising:

a plurality of floral grouping assemblies;

shipping means having a support surface for accommodating the floral grouping assemblies;

a sheet of material disposed in contact with at least a portion of the support surface of the shipping means and with at least a portion of at least one of the floral grouping assemblies to be shipped;

a bonding material; and wherein the bonding material bondingly connects at least a portion of the sheet of material to the support surface of the shipping means and the bonding material further bondingly connects at least a portion of each of the floral grouping assemblies to the sheet of material and wherein the floral grouping assemblies are positioned in at least two tiers with a portion of the sheet of material separating the two tiers.

8. The shipping assembly of claim 7 wherein the bonding material comprises an adhesive or cohesive bonding material.

* * * * *